US009435188B2

(12) United States Patent
Gray

(10) Patent No.: US 9,435,188 B2
(45) Date of Patent: Sep. 6, 2016

(54) FORMATION PRESSURE SENSING SYSTEM

(71) Applicant: Ian Gray, Acacia Ridge (AU)

(72) Inventor: Ian Gray, Acacia Ridge (AU)

( * ) Notice: Subject to any disclaimer, the term of this patent is extended or adjusted under 35 U.S.C. 154(b) by 189 days.

(21) Appl. No.: 14/350,380

(22) PCT Filed: Oct. 10, 2012

(86) PCT No.: PCT/AU2012/001221

§ 371 (c)(1),
(2) Date: Apr. 8, 2014

(87) PCT Pub. No.: WO2013/052996

PCT Pub. Date: Apr. 18, 2013

(65) Prior Publication Data

US 2014/0318771 A1 Oct. 30, 2014

(30) Foreign Application Priority Data

Oct. 11, 2011 (AU) ..... 2011904211

(51) Int. Cl.

| | |
|---|---|
| ***E21B 47/00*** | (2012.01) |
| ***E02D 33/00*** | (2006.01) |
| ***E21B 47/06*** | (2012.01) |
| ***E21B 33/13*** | (2006.01) |
| ***E21B 47/01*** | (2012.01) |

(52) U.S. Cl.
CPC ..... *E21B 47/00* (2013.01); *E02D 33/00* (2013.01); *E21B 33/13* (2013.01); *E21B 47/01* (2013.01); *E21B 47/06* (2013.01)

(58) Field of Classification Search
CPC ..... E21B 49/08; E21B 49/008
See application file for complete search history.

(56) References Cited

U.S. PATENT DOCUMENTS 3,193,010 A * 7/1965 Bielstein ..... E21B 33/14 166/285
4,429,748 A * 2/1984 Beck ..... E21B 34/108 166/323
4,673,035 A * 6/1987 Gipson ..... E21B 19/22 166/77.1
5,409,071 A * 4/1995 Wellington ..... E21B 47/0005 166/253.1
5,467,823 A * 11/1995 Babour ..... E21B 33/14 166/250.01
6,125,935 A * 10/2000 Shahin, Jr. ..... E21B 33/14 166/250.14
6,279,392 B1 * 8/2001 Shahin, Jr. ..... C09K 8/42 166/250.14
6,786,086 B2 * 9/2004 Hashem ..... E21B 49/008 702/12
6,994,167 B2 * 2/2006 Ramos ..... C04B 24/003 166/173
2004/0180793 A1 * 9/2004 Ramos ..... C04B 24/003 507/200
2008/0078582 A1 * 4/2008 Phan ..... E21B 49/10 175/58

FOREIGN PATENT DOCUMENTS

WO WO 03/029614 4/2003
WO WO 2010/128943 11/2010

* cited by examiner

*Primary Examiner* — Angela M DiTrani
*Assistant Examiner* — Andrew H Sue-Ako
(74) *Attorney, Agent, or Firm* — Roger N. Chauza, PC

(57) ABSTRACT

A method of installing a pressure transducer in a borehole to measure the fluid prepare of a geological formation. The pressure transducer is installed into the borehole at a desired depth, and then the borehole is filled with a cement grout. The fluid connection between the pressure transducer and the formation is opened by pumping a fluid through tubing to displace the cement grout. A process of hydrofracture can be employed to provide a communication path of fluid between the formation and the pressure transducer surrounded by the fractured grout. In one embodiment of the invention, a pressure transducer is cemented into the borehole along with a check and pressure relief valve. In another embodiment, the pressure transducer is installed in the tubing at a subsequent stage.

15 Claims, 7 Drawing Sheets

FORMATION PRESSURE SENSING SYSTEM

RELATED PATENT APPLICATION

This international PCT patent application claims priority to Australian provisional patent application filed 11 Oct. 2011, and accorded application number 2011904211. The disclosure of the Australian provisional patent application is incorporated herein by reference.

TECHNICAL FIELD OF THE INVENTION

The present invention relates in general to the monitoring and measuring of fluid pressures in geological formations, and more particularly to measuring techniques which more accurately measure the fluid pressure in the formation at a desired elevation or depth, without being influenced by pressures in the formation above and below the pressure measuring apparatus.

BACKGROUND OF THE INVENTION

The measurement of pressures in geological formations is often of great importance to engineering and environmental matters. To the civil engineer, pore pressures in soils are important in the design of foundations, slopes and retaining walls. To the hydro-geologist, pressures in aquifers and aquicludes are a key to determining groundwater resources and movement. To the petroleum engineer, understanding the pressure of the fluids is critical in determining the resources and reserves of petroleum fluids.

The civil engineering industry often refers to pressure monitoring systems as piezometers. Piezometers take a variety of forms. The most traditional piezometer involves the placement of an open tube standpipe into a borehole with a sand or gravel pack around a slotted tip. A bentonite seal is placed above the gravel pack and the remainder of the hole is cemented. Variations on this theme exist with some standpipes being fitted with a filter tip, where the filter tip is driven into a clay.

The fluid level is generally measured in standpipe piezometers by measuring the water level therein either manually by some form of dipping system, or by the measurement of pressure above a certain point in the standpipe. This has previously been accomplished by measuring the required pressure to force a bubble out of a tube in the standpipe, but is more commonly undertaken by the use of pressure transducers.

The disadvantage of the standpipe system is that the standpipe has a significant volume. To produce a change in the volume of the fluid in the standpipe, fluid must either come out of the formation to fill the standpipe, or pass from the standpipe into the formation. This requires the formation to have an adequate permeability and storage characteristic to operate with the standpipe. This pressure measuring technique also requires a very good connection between the standpipe and the formation. In all cases, the standpipe adversely functions to dampen the true pressures of the formation.

To overcome the volumetric problems with the use of standpipes, low volume pressure transducers were fixed in a filter zone in a borehole or structure. Because of the inherent instability of early electronic devices, pneumatic piezometers were developed. In the use of pneumatic piezometers, two tubes were fitted to the transducer—one to permit the passage of compressed air to the device, and the other to permit the return of the compressed air after it passed through a pneumatic valve. The pressure of the fluid in the formation was detected by the pressure required to pneumatically open the valve, as detected by the airflow up the return tube. This type of transducer was particularly well suited to the monitoring of earth dams as the tubing and transducers could be easily incorporated into the earth structure.

The next major development was to use electrical transducers, particularly of a vibrating wire type. This type of transducer exhibited better long term drift characteristics as compared to the bridge type transducers of the same era. The vibrating wire transducers had very low volumetric requirements to operate an internal diaphragm, and as such were easily incorporated into filter zones within boreholes. The availability of vibrating wire transducers made it possible to install multiple transducers into a single borehole, although this was generally accomplished by the use of multiple levels of gravel packing and cementing.

The next major development was the realisation that in many cases a pressure transducer could be cemented directly into a borehole. To make this possible, the pressure sensing diaphragm of the transducer must be isolated from the direct contact with the cement, and the cement required adequate permeability to permit a fluid connection between the geological formation and the transducer. With this installation method, there is always an uncertainty as to what is connected to what, i.e. is the formation fluid at the same elevation as the transducer in the borehole, or is the fluid in the formation at some other level in the borehole? It has been generally assumed that the pressure measured by the transducer is that of the formation fluid located directly adjacent to where the transducer has been installed. This may not, however, be universally correct as, if the formation adjacent to the transducer is extremely impermeable, and the formation further up the hole is not, then depending on the relative permeabilities of the formations and the cement grout, the pressure measured may not be that produced by the formation located directly adjacent to the pressure transducer. This becomes particularly problematic if shrinkage of the cement grout occurs, which leads to longitudinal leakage paths within the cured grout. When this occurs, the pressure transducer can be influenced by formation pressures that exist above and below the pressure transducer. In this event, the pressure transducer measures the composite of all of the formation pressures to which it is exposed.

Because most exploitable aquifers have high permeability and storage characteristics, the groundwater industry has generally managed to utilise traditional standpipes or the use of monitoring wells. In low permeability formations, investigations have been undertaken to consider low volume fluid pressure measuring techniques.

The petroleum industry is a field where the measurement of geological formation pressures was traditionally accomplished by pressure measurements in test wells or production wells. This situation has since changed dramatically with the introduction of several formation testing tools. Permanent monitoring of formation pressures has also grown with the use of pressure transducers which are fixed in the casing, or to the tubing, having been run into a well and cement grouted into place.

Lastly, it has been proposed that one or more pressure sensing lines could be grouted in the borehole formed in a coal seam to measure the fluid pressures therein. This technique is disclosed in a technical paper published in SPE Reservoir Engineering (February 1987) and entitled 'Reservoir Engineering in Coal Seams: Part 2—Observations of Gas Movement in Coal Seams' by Ian Gray. According to this technique, the pressure sensing line(s) is strapped to a PVC conduit and the assembly is lowered into the borehole. The borehole is grouted around the assembly, and the line is filled with water to prevent the grout from flowing up the pressure sensing line. The PVC pipe can accommodate the flow of grout therein. After the grout has set, the pressure sensing line is pressurised to fracture the grout and create an opening to the coal seam. The pressure sensing line can be connected to a pressure gauge or chart recorder located at the surface.

From the foregoing, it can be seen that a need exists for a fluid measuring technique that more accurately measures the fluid pressure in the part of the formation that is at the same depth, elevation or vicinity of the pressure sensor. A further need exists for isolating the pressure sensor in a borehole so that it is only exposed to the fluid pressure in the formation adjacent to the pressure sensor and not to the formation pressure at another position in the hole. A further need exists for a method to isolate the pressure sensor in the borehole using a cement grout between the pressure sensor and the borehole, and then opening a communication path in the cement grout between the pressure sensor and the wall of the borehole where the formation fluid pressure is to be measured. Yet another need exists to undertake the installation of one or more sensors in a single cementing operation.

SUMMARY OF THE INVENTION

The various features of the invention permit a more reliable connection system between a pressure sensing location within a cement grouted borehole and the transducer system used to monitor the pressure in the surrounding geological formation. This is accomplished by cementing a conduit fitted with a filter at its bottom end in the borehole at a desired location. The filter is the inlet to the pressure measuring apparatus. The conduit is pressurised with fluid to clear the conduit of any cement grout during this operation. A valve is used to block the backflow of cement grout from the borehole back into the conduit. The valve is preferably a check valve.

Once the cementing operation is complete, but before the cement grout has completely set, a fluid is again introduced into the conduit. The fluid is forced out of the bottom end of the conduit (and the filter) and displaces the cement grout to achieve a fluid connection between the formation and the filter. The process of introducing the fluid into the conduit is preferably accomplished in several stages. The first stage of the initial fluid injection is to ensure the filter end of the conduit is cleaned of cement grout. The second stage of fluid injection takes place to move the cement grout in the borehole from around the bottom end of the conduit. The second stage is normally carried out when the cement grout has started to set. The final fluid injection stage can be advantageously employed to ensure connectivity in certain circumstances, and follows the full setting of the cement grout. In this final stage, a fluid is pumped through the conduit and filter at adequate pressure to cause the local hydrofracture of the geological formation located laterally adjacent to the filter. As such, pressures produced by the geological formation at the filter depth are coupled directly to the input of the pressure measuring apparatus.

In an alternative process, the fracturing of both the grout and the formation can be accomplished following the filter washing and setting of the grout.

According to a feature of the invention, the cement grout is pumped through the borehole formed in the formation using either a grout pipe to convey the grout from the base upwards in the borehole, or if grouting is being undertaken from a borehole collar, a return tube is employed.

In one embodiment of the invention suitable for any reservoir type, a pressure transducer is installed at a desired depth in a bore to measure formation pressures at such depth. The pressure transducer is placed between a filter and a check valve equipped with a pressure relief valve. The check valve is of the type that opens at a predetermined pressure. The opening pressure of the check valve is designed to prevent a standing fluid level in the fluid monitoring zone. The installation involves the lowering of the pressure transducer into the formation on the end of a cable, together with a conduit that is typically a small diameter tubing pipe (typically ¼' diameter). Cement grouting of the borehole is undertaken along with the staged process of fluid injection in the conduit to clear the filter of grout and then displace the grout so that the filter is in communication with the formation pressure to be measured. In certain circumstances the method can be followed by a hydrofracture process once the grout has set.

In another embodiment of the invention the conduit run into the borehole can be constructed with a small diameter tubing pipe connected to a larger diameter tubing section located near the surface. The installation of the tubing pipe would normally, but not necessarily, be strapped to a grout pipe. When located at a desired depth in the borehole, the top of the tubing pipe is filled with fluid and fitted with a non-return valve. The non-return valve may be automatically or manually operated to achieve a no-return behaviour. The grouting operation for the borehole is then undertaken, whereupon the non-return valve prevents fluid from being pushed out of the conduit due to density or pumping pressure difference. Once grouting is complete, a small volume of fluid is pumped through the conduit to clean the filter. This is followed by the pumping of additional fluid into the conduit to displace the grout in the borehole radially around the inlet filter, usually when the grout has started to set, to avoid mixing the fluid and the grout. In some cases the method can be followed by a hydrofracture process once the grout has set. In this embodiment, fracturing pressures are not impeded by the pressure limitations of the downhole transducer used in the embodiment described above. Once the grout has set, the non-return valve is removed and the pressure sensing transducer is run into the top of the conduit. It is undesirable to permit fluid movement within the conduit as this requires the formation to supply or receive that fluid. To avoid this and to permit the pressure transducer to be located in its most suitable pressure range, the pressure transducer is preferably attached to a packer which is lowered with it into the enlarged upper portion of the conduit. The packer may then be set to block the upper end of the conduit. In this embodiment, the transducer can be removed periodically for calibration or maintenance. It is also possible to alter the location of the transducer within the conduit to suit the pressure range of the device. This embodiment is ideally suited to high accuracy monitoring of groundwater where the fluid in the conduit is a liquid (preferably water) of known density. Preferably the density of the fluid should match that of the reservoir located in the geological formation.

According to a further embodiment of the invention, disclosed is a method of monitoring a fluid pressure in a subterranean formation. The method includes forming a borehole in the subterranean formation at least to a depth where the fluid pressure is to be measured, and then placing a conduit into the borehole to a depth so that a bottom inlet end of the conduit is laterally adjacent a location where the formation pressure is to be measured. A non-return valve is used in the conduit so that liquid cannot pass upwardly all the way through the conduit. A cementitious material is placed in the borehole until the cementitious material rises at least above the bottom inlet end of the conduit. A liquid is pumped down the conduit through the non-return valve, out of the inlet end of the conduit and into the cementitious material in the borehole to displace the cementitious material around the bottom inlet end of the conduit to thereby form a fluid connection to the formation. A pressure sensing device is coupled to the formation fluid pressure within the conduit to measure the fluid pressure of the formation at the desired depth.

According to yet another embodiment of the invention, disclosed is a method of monitoring a fluid pressure in a subterranean formation, which includes forming a borehole in the subterranean formation at least to a depth where the fluid pressure is to be measured. A pressure sensing device is connected to a bottom inlet end of a conduit so that the pressure sensing device measures fluid pressures at the inlet end of the conduit, and the conduit is lowered into the borehole until the inlet end of the conduit is at a depth where the formation pressure is to be measured. The borehole is then filled with a cementitious material to a level substantially above the inlet end of the conduit and the cementitious material is prevented from flowing up the conduit, whereby the cementitious material surrounds the inlet end of the conduit. The inlet end of the conduit is purged of cementitious material by pumping a liquid down the conduit. A lateral fluid path is formed between the inlet end of the conduit and the formation, whereby the formation pressure forces the formation fluid to flow through the fluid path and through the inlet end of the conduit to the pressure sensing device so that the formation fluid pressure is measured.

According to yet a further embodiment of the invention, disclosed is a method of monitoring a fluid pressure in a subterranean formation, which includes placing a conduit in a borehole formed in the subterranean formation so that a pressure measuring inlet of the conduit is located at a depth where the formation pressure is to be measured. A pressure sensing device is connected to the conduit to measure pressures at the pressure measuring inlet of the conduit. The borehole is filled with a cementitious material above and below the pressure measuring inlet of the conduit so that the pressure measuring inlet has a fluid communication path outwardly to the formation, but the pressure measuring inlet of the conduit is isolated by the cementitious material from other portions of the formation located above and below the pressure measuring inlet of the conduit.

BRIEF DESCRIPTION OF THE DRAWINGS

Further features and advantages will become apparent from the following and more particular description of the preferred and other embodiments of the invention as illustrated in the accompanying drawings, in which like reference characters generally refer to the same parts, functions or elements throughout the views, and in which.

DETAILED DESCRIPTION OF THE INVENTION

Figure 1A:
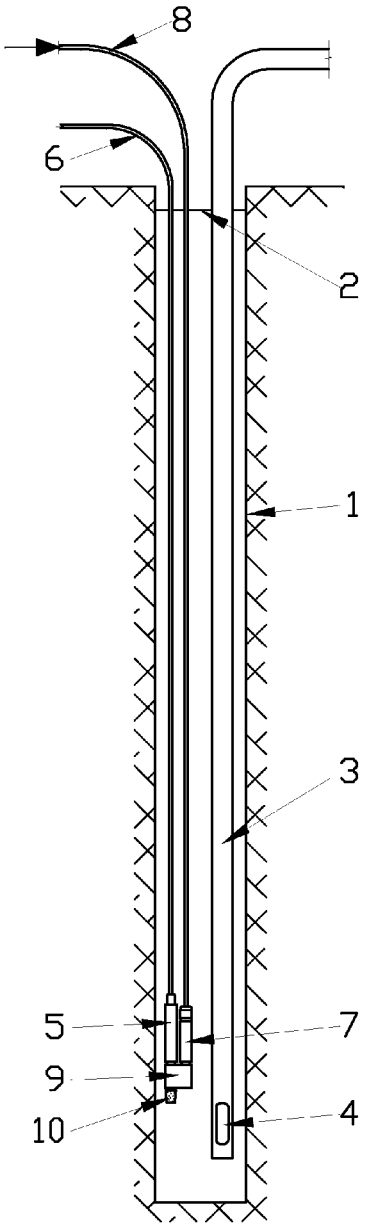
FIGS. 1A-1D illustrate the sequence of installation steps of a formation pressure sensing system according to the first embodiment, which incorporates a permanent downhole pressure transducer.

FIG. 1A illustrates a borehole (1) which has been drilled in the ground. Situated in the borehole (1) is a grout pipe (3) for carrying a cementitious material, such as a cement grout. Materials other than cement grout can be employed with equal effectiveness. The grout pipe (3) is constructed with a port (4) near its base to permit the cement grout to be deposited at the bottom of the borehole (1). Also located in the borehole (1) is a pressure sensor arrangement comprising a connector block (9) for internally connecting together a filter (10), a pressure transducer (5) and a check valve (7). The filter (10) can be any type of filter, and can be of sintered metal construction to prevent formation debris from clogging the input of the pressure transducer (5). The check valve (7) is preferably of the type which is preset to open at a suitable differential pressure. The pressure transducer (5) is lowered into the borehole (1) via a fluid injection pipe (8) which extends to the surface. Moreover, the pressure transducer (5) is located in the borehole (1) at a location where the corresponding formation fluid pressure is to be measured.

As noted above, the connector block (9) is internally cross ported to connect together the filter (10), the pressure transducer (5) and the check valve (7). The pressure transducer (5) is electrically connected to the surface by a cable (6) which transfers signals corresponding to the differential pressure across the transducer (5). The pressure transducer (5) can be of the conventional piezometer type for sensing the differential pressure across a movable diaphragm, and providing a corresponding electrical signal output. Other types of pressure sensors having electrical outputs can be employed with equal effectiveness. The check valve (7) is connected to the fluid injection pipe (8) which also extends to the surface.

Prior to grouting the borehole (1) via the grout pipe (3), the fluid injection tube (8) is filled with a liquid, such as water, under sufficient pressure that the fluid passes through the check valve (7), the connector block (9), out of the filter (10) and into the borehole (1). The liquid is pumped into the injection tube (8) to clear the system of any bubbles of gas and to ensure the filter (10) is clear of any blockage which may have occurred during its placement in the borehole (1).

Figure 1B:
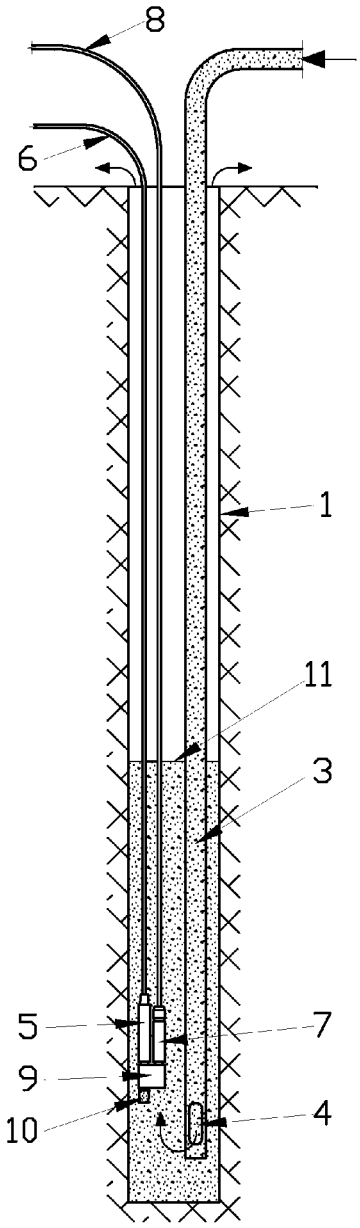

FIG. 1B illustrates the borehole (1) during the grouting operation in which a cement grout material is pumped down the grout pipe (3). The cement grout exits the grout pipe (3) via the bottom port (4) where it fills the bottom of the borehole (1) and flows upwardly where it temporarily reaches a level at location (11). It can be appreciated that during the grout pumping operation, the pressure sensor arrangement is surrounded with the cement grout material.

Figure 1C:
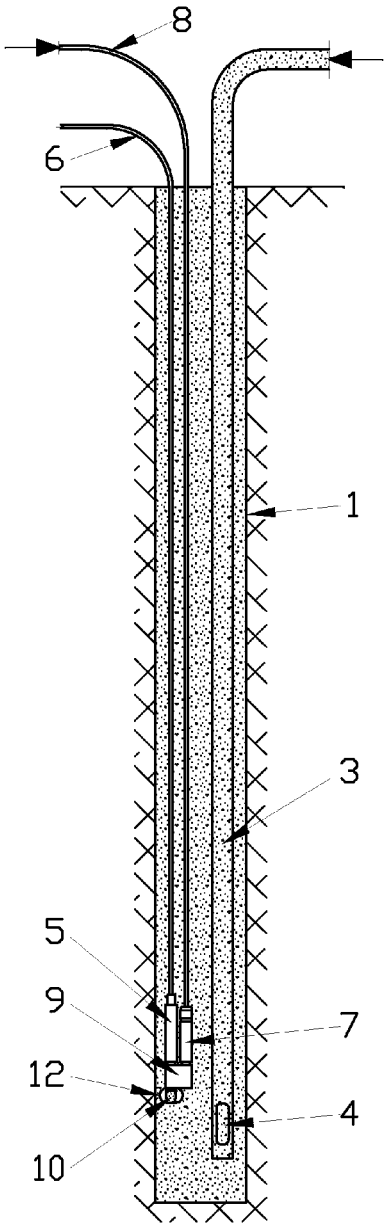

FIG. 1C illustrates the borehole (1) which is filled with the cement grout material. As can be seen, the filling of the borehole (1) with the cement grout from the bottom up displaces the liquid in the borehole (1). At this time, a small amount of liquid is pumped down the injection tube (8) through the check valve (7) and filter (10) to clear the filter (10) of the grout material.

Figure 1D:
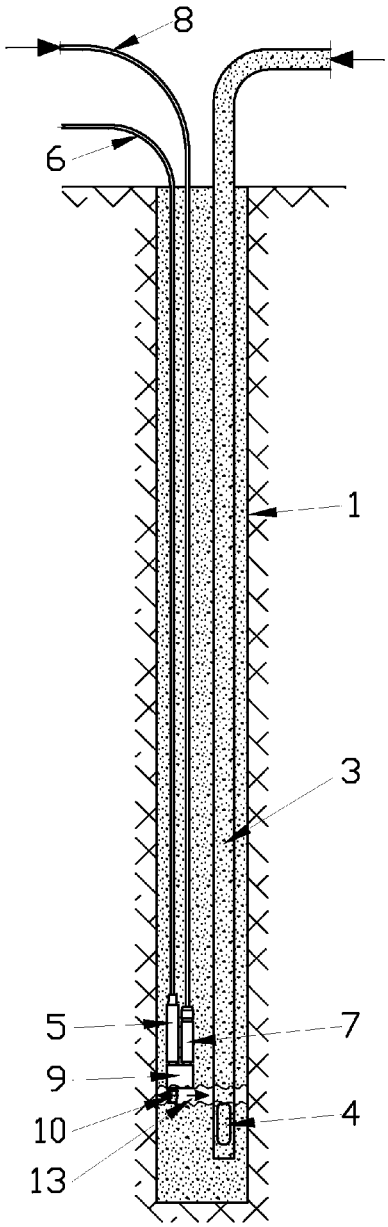

FIG. 1D illustrates the next stage of the fluid injection operation which displaces the cement grout from around the filter (10) to form a void at location (13) and to provide a fluid connection from the formation through the parted cement grout (13) and thence back through the filter (10) and connector block (9) to the pressure transducer (5). The injection liquid is prevented from passing back up the injection tube (8) by the check valve (7). This stage is preferably undertaken when the cement grout has started to set so that the addition of the injection fluid via the filter (10) does not dilute the grout. The grout material is then left undisturbed until fully set.

Figure 2:
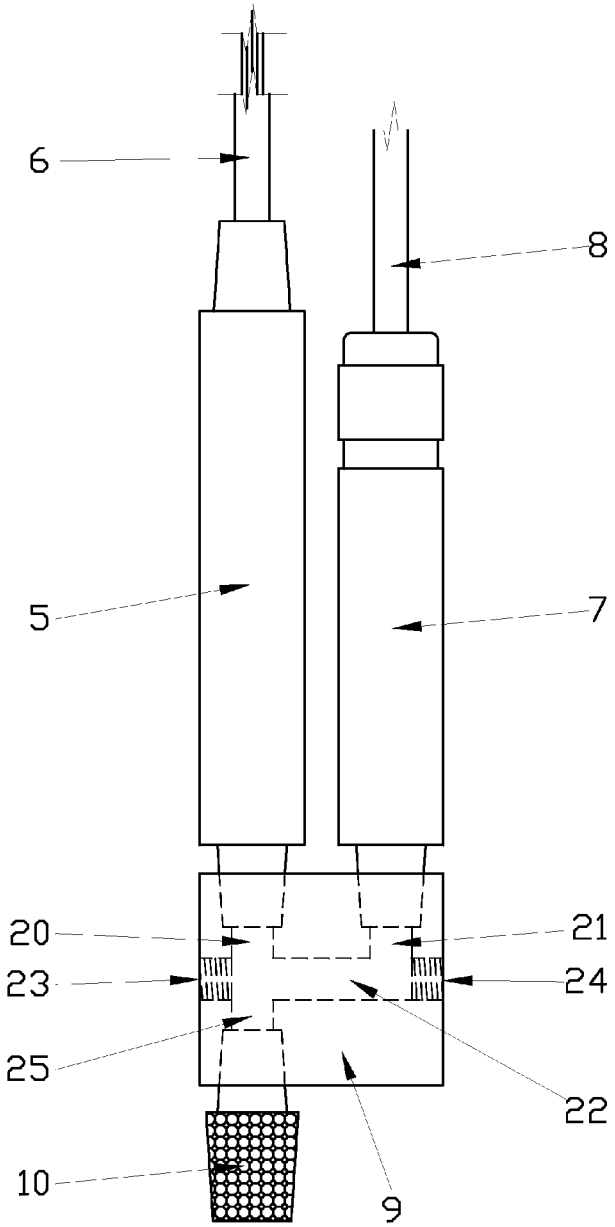
FIG. 2 is a component diagram illustrating the details of the pressure sensor arrangement, including a pressure sensor, a check valve and a filter.

FIG. 2 illustrates the pressure transducer assembly which includes the connector block (9) with the pressure transducer (5) screwed therein so as to be connected to the internal porting of the connector block (9). The pressure transducer (5) is of the type where the top of the pressure sensing member is exposed to pressure which is the reference internal pressure of the transducer and is preferably a vacuum, or in shallow applications may be vented by another conduit (not shown) to atmospheric pressure. The bottom of the pressure sensing member is exposed to the fluid pressure produced by the geological formation. The electrical output of the pressure transducer (5) is connected to an electrical cable (6), which carries the electrical pressure signals to surface-located monitor equipment. The electrical signals can be carried to surface-located equipment and converted to conventional pressure readings, such as millibars, psi, etc. The pressure signals can also be transmitted via telemetry equipment to remote locations where the pressures of a number of geological formations can be monitored.

A preset pressure relief type of check valve (7) is similarly screwed into the connector block (9), as is the filter (10). The connector block (9) contains internal passages (20), (21), (25), and (22) to provide a common connection between the components connected to the block (9). The passage (20) is blocked by grub screws (23) and (24) to prevent communication of the internal passages of the connector block (9) with the borehole (1). The fluid injection pipe (8) is connected to the inlet side of the pressure relief and check valve (7). As described above, the fluid injection pipe (8) is supplied with a fluid from up hole pump equipment.

From the foregoing, described is an embodiment of a formation fluid pressure sensing system in which the pressure transducer (5) is precisely located down a borehole (1) at a location where the pressure in the geological formation is to be measured. The pressure transducer (5) together with a filter (10) is fixed in the borehole (1) at the desired location by placing a cement grout around the pressure transducer (5). Before the cement grout is fully cured, a liquid is pumped down hole through a check valve (7) to clear the filter (10) of the cement grout material. Subsequently a fluid is again pumped down the borehole (1) through the check valve (7) to form a void or communication path between the formation and the pressure transducer (5). The cement grout material around the void (13) isolates the pressure transducer (5) in the borehole (1), except the laterally adjacent portion of the geological formation where it is desired to obtain fluid pressure measurements.

Figure 3A:
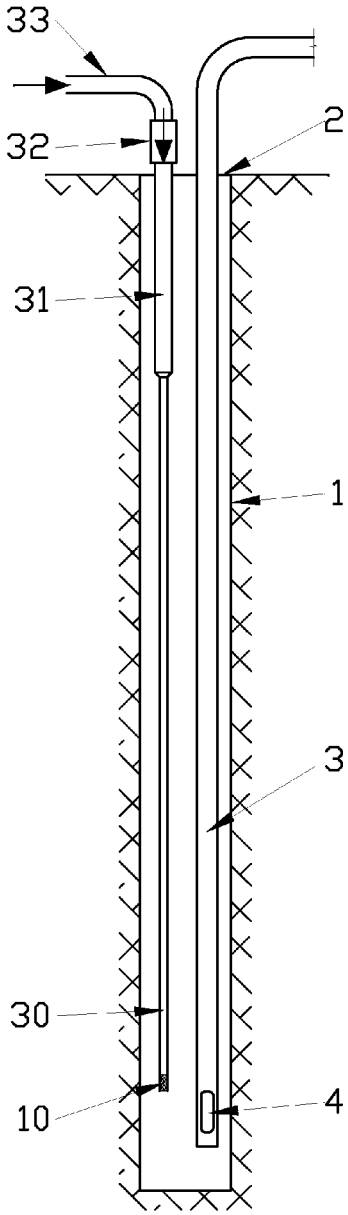
FIGS. 3A-3F illustrate the sequence of installation steps of a formation pressure sensing system, including a hydrofracture stage, of the second embodiment of the invention where the transducer is readily accessible from the surface.

FIGS. 3A-3F illustrate another embodiment of the invention. In FIG. 3A, a borehole (1) is formed in the geological formation in which it is desired to determine the fluid pressure at a particular depth. A grout pipe (3) is installed in the borehole (1) so that the borehole (1) can be filled with a cement grout material from the bottom. To that end, the grout pipe (3) is constructed with a port (4) near its base through which cement grout can be pumped into the bottom of the borehole (1). Also installed at a desired location in the borehole (1) is a filter (10) which is connected to the bottom of a fluid injection tube (30). According to this embodiment, the check valve (32) and the pressure transducer (5) (shown in FIG. 3F) are not connected to the bottom end of the fluid injection tube (30). Near the top of the borehole (1), the injection tube (30) is connected to a larger tube (31). At the surface of the borehole (1) site, the check valve (32) and an input tube (33) are connected to the larger tube (31). A fluid is pumped through the input tube (33), which then passes through the check valve (32), the large tubing (31), the smaller fluid injection tube (30) and filter (10) before passing into the borehole (1). As shown, the pumped fluid has risen in the borehole (1) to a level (2).

Figure 3B:
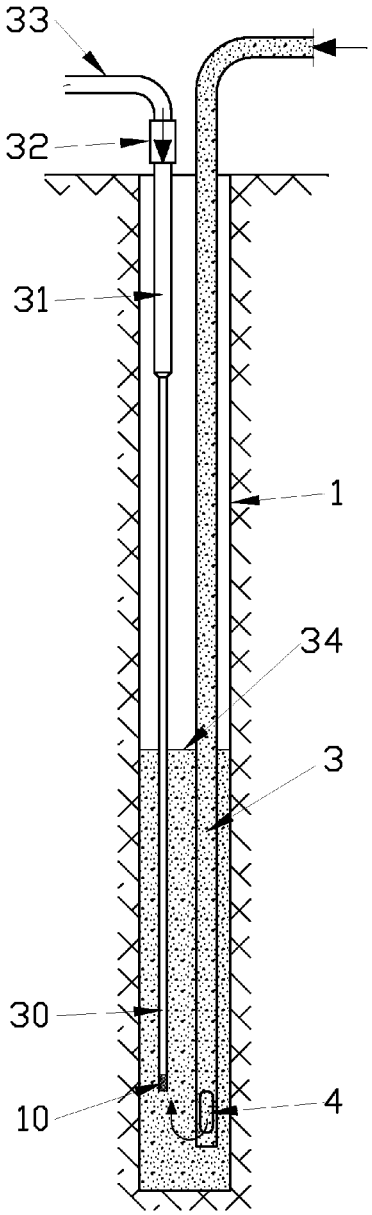

FIG. 3B illustrates the next step in the method in which the cement grout is pumped down the grout pipe (3) and out of the bottom port (4) into the bottom of the borehole (1). At this time, the cement grout moves upwardly in the borehole (1) and reaches level (34). The cement grout continues to be pumped into the grout pipe (3) until the borehole (1) is filled to a desired level. The raised pressure at the filter (10) and the action of the check valve (32) prevent either the fluid or the cement grout from passing back up the tubing (30) and (31). As can be appreciated, any formation fluid initially in the borehole (1) is displaced with the cement grout material.

Figure 3C:
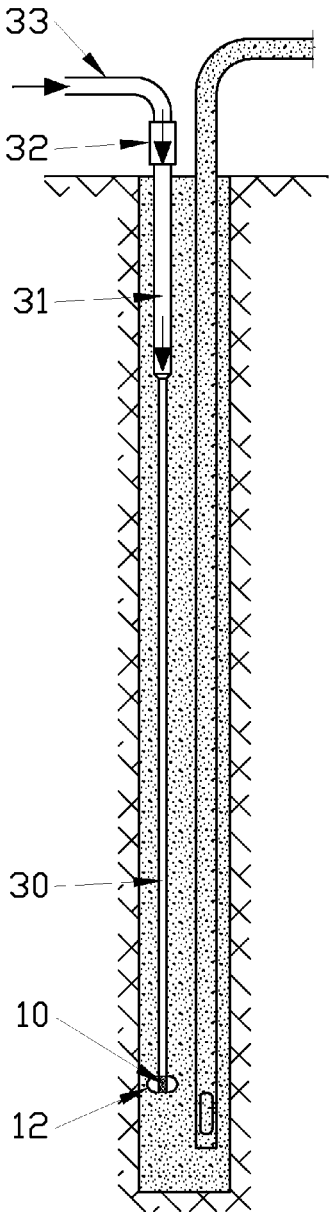

FIG. 3C illustrates a step in the operation in which a fluid, such as water, is pumped into the surface-located input tube (33). The fluid passes through the check valve (32) and through the fluid injection tubing (31) and (30) to clear the filter (10) of the fresh cement grout. A small diluted area of cement grout around the filter (10) is shown at location (12).

Figure 3D:
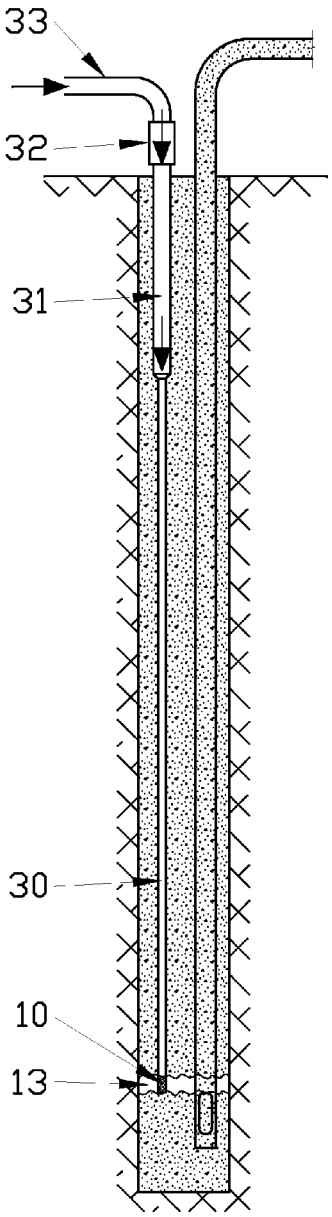

FIG. 3D illustrates the next stage, preferably when the cement grout at location (13) has started to set. This prevents dilution of the cement grout around the filter (10). According to a feature of the invention, the fluid is pumped into the surface input tube (33) so that the fluid is forced out of the filter (10), and displaces the cement grout at location (13) around the filter (10). The displaced cement grout forms a pocket, void or fluid pathway between the filter (10) and that part of the borehole (1) sidewall that is laterally adjacent to the filter (10). The filter (10) connected to the bottom end of the injection tube (30) is thus adjacent to that part of the geological formation where the fluid pressure is to be measured. Importantly, the cement grout confines the inlet to the pressure sensor arrangement to the formation pressures that exist at the desired elevation. As will be described below, the inlet to the pressure sensor arrangement is the filter (10). The filter (10) prevents cement grout particles entering the injection tube (30), and at a later stage the ingress of any particles with formation fluid. The filter (10) could be omitted in some cases. In this case the inlet to the pressure sensor arrangement would be the bottom end or inlet port of the injection tube (30). The isolation of the pressure transducer input prevents it from being influenced by borehole fluid pressures above or below the filter (10), which would otherwise occur.

Figure 3E:
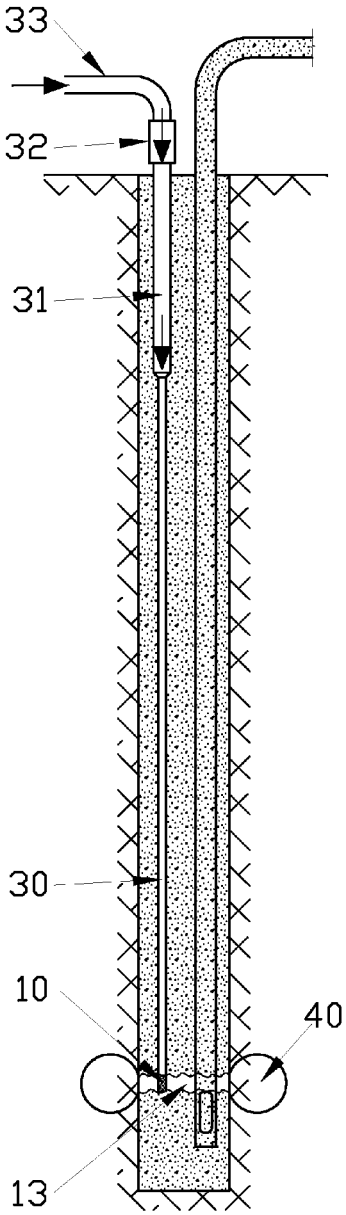

FIG. 3E illustrates the operation which is carried out after the cement grout has set. In this case, a pressurised fluid is pumped into the surface input tube (33) to displace fluid from the injection tubing (31) and (30), through the check valve (32) and out of the filter (10) through the opened cement grout at location (13). The pressure of the fluid pumped into the input tube (33) is sufficient to fracture the formation at location (40) via the void area (13) around the filter (10). The hardened cement grout in the borehole (1) above and below the void area (13) functions to concentrate the pressurised fluid in the annular area of the formation surrounding the filter (10) component of the pressure sensor arrangement. Depending on the pressure and volume of the injected fluid, the fracture zone (40) of the geological formation can extend radially outwardly from the borehole (1) a significant distance. After fracturing the formation, the natural pressures of the geological formation cause the formation fluid to enter the fracture zone (40) into the void area (13), and from the filter (10) to the pressure transducer (5) described in FIG. 3F.

Figure 3F:
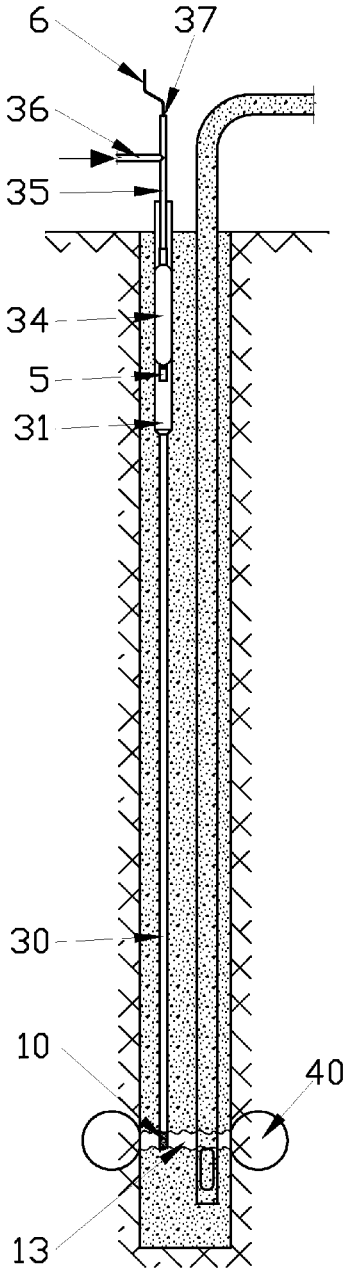

FIG. 3F illustrates the borehole (1) set up for monitoring the fluid pressure around the borehole (1) at fracture location (40). Here, the surface input tube (33) and check valve (32) are removed from the large injection tube (31). The large injection tube (31) remains connected to the underlying smaller tubing (30). A packer (34) carrying a pressure transducer (5) at its bottom end is inserted into the large tube (31) and sealed therein. The pressure transducer (5) is of the type where the top of the pressure sensing member is exposed to the transducer internal pressure which is preferably a vacuum, or in shallow applications to monitor an unconfined aquifer, may be advantageously connected to atmospheric pressure via a conduit (not shown), and the bottom of the pressure sensing member is exposed to the fluid pressure produced by the geological formation. The packer (34) is inflated and sealed in the large tube (31) by fluid pressure delivered through a tube (36) connected to the packer inflation tubing (35). The packer (34) effectively plugs the large tube (31) so that the pressure in the formation can pressurise the lower injection tube (30). To that end, the packer (34) functions as a seal to block the flow of formation liquid in the large tube (31). The top (37) of the packer inflation tubing (35) is sealed around the electrical cable (6) which carries the electrical signals from the pressure transducer (5). It must be realised that the pressure transducer (5) is removable and/or relocatable within the large tube (31). This provides the user with the advantage of servicing the transducer (5) or relocating it to a depth suited to its pressure range. The pressure transducer (5) is relocatable to a different depth by deflating the packer (34), and moving it together with the attached pressure transducer (5) to a different elevation in the large tube (31). When moved to the new depth, the packer (34) is again inflated to fix it in the large tube (31) in the manner described above. The packer (34) is described above as an inflatable device. In another embodiment it could be a mechanically expandable packer or a seal element which may be slid within the injection tube (31). In the latter case a vent would need to be incorporated into the device to permit fluid to pass through the seal when it is being moved. As can be seen in this embodiment, the pressure sensor arrangement includes components that are not all located in the same area, but rather are distributed in the system.

In operation, the fluid pressure produced by the geological formation enters the pressure sensing system through the formation fractures to the void zone (13) around the filter (10). Again, this occurs at an elevation in the formation where it is desired to measure the pressure. The pressure of the formation fluid rises in the injection tube (30) and exerts a corresponding force on the bottom of the pressure sensing member of the pressure transducer (5). The top of the pressure sensing member is held at a static pressure, and thus the pressure transducer is able to accurately measure the formation pressure. In some instances the transducer will be used to measure water head in a groundwater body with a phreatic surface. In this case it is advantageous to vent the top of the pressure sensing member to atmospheric pressure and the bottom to the local groundwater pressure. Changes in the formation pressure, if any, are sensed by the pressure transducer (5) and coupled by corresponding electrical signals to the surface monitoring equipment.

It should be appreciated that while reference is made in FIGS. 3A to 3F of a tube (30) being of smaller size than the upper tubing (31), this is not a necessary feature of the invention. The tubing could be of the same size provided it is large enough to take the transducer (5) and seal. The choice of tubing sizes is dependent on the local economics of the situation and the degree of variability in location that is required for the packer (34) and transducer (5) combination to monitor formation fluid pressure.

Figure 4:
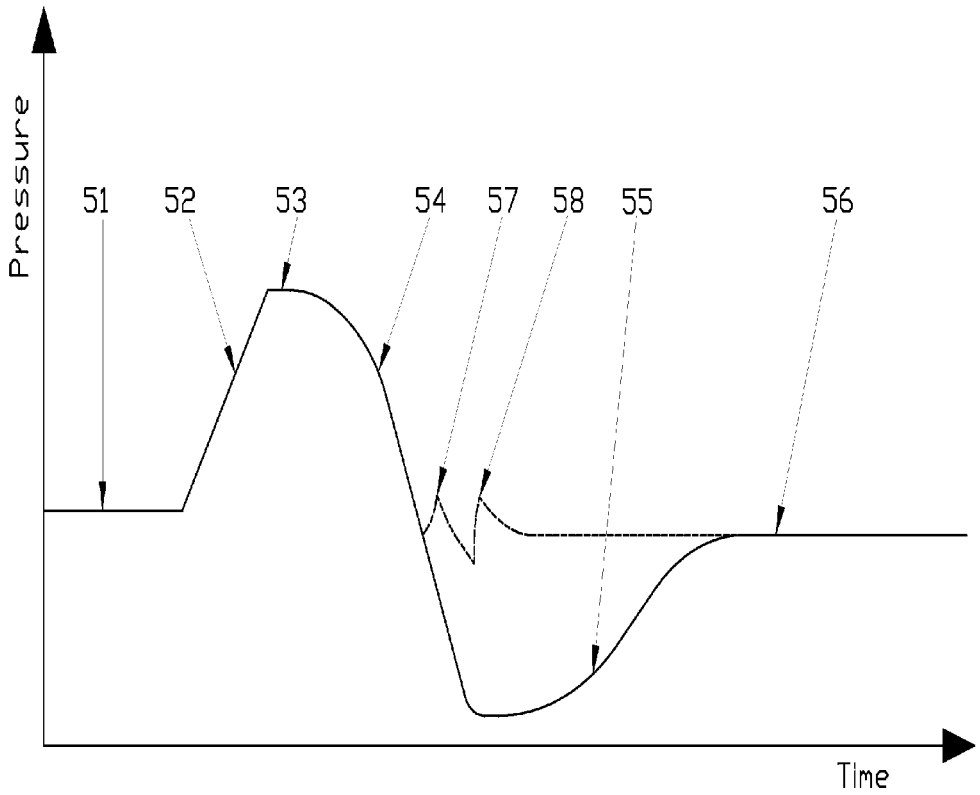
FIG. 4 shows graphically the chronological record of pressure for a pressure transducer such as that installed in FIGS. 1A-1D.

FIG. 4 shows a typical chronological record of pressure at the transducer (5) for the installation described in FIGS. 1A to 1D. Here, the borehole (1) is filled with fluid with an initial borehole hydrostatic pressure (51). With the pumping of cementitious grout up hole and past the transducer (5), the pressure increases (52) to final hydrostatic pressure (53) of the cementitious grout. As hydration takes place the fluid pressure of the cementitious grout pressure begins to decline (54). The pressure may decline to far below formation pressure before recovery (55) begins to reach formation pressure (56). This drop in pressure is more severe if the cement grout has lost fluid to the formation prior to hydration. The dotted line shows the advantageous use of fluid injection to maintain pressure at the transducer (5) to approximate formation pressure. Here, injection is conducted twice to reach peak pressures at (57) and (58) before the pressure asymptotes to the final reservoir pressure.

From the foregoing, disclosed are various embodiments of geological formation pressure sensing systems that more accurately measure the formation pressures at desired depths. The inlet to the pressure sensing apparatus is located at a desired depth in the formation, and isolated to pressures produced by the formation at such depth. As such, the measurement of the formation pressure is not affected by other and different pressures that could otherwise exist in the borehole above and below the inlet to the pressure measuring apparatus.

While the preferred and other embodiments of the invention have been disclosed with reference to specific formation pressure sensing systems, and associated methods and manufacture thereof, it is to be understood that many changes in detail may be made as a matter of engineering choices without departing from the spirit and scope of the invention, as defined by the appended claims.

The invention claimed is:

1. A method of monitoring a fluid pressure in a subterranean formation, comprising:

forming a borehole in the subterranean formation from a surface at least to a depth where the fluid pressure is to be measured;

placing a grout pipe down the borehole, said grout pipe having a port at a bottom end thereof for allowing a cementitious material to flow therethrough;

placing a conduit, different from said grout pipe, into the borehole to a depth so that an inlet of the conduit is adjacent an uncased portion of the borehole and at a location where the formation pressure is to be measured, the inlet of said conduit is located at a depth in said borehole independent of a location of the port at the bottom of said grout tube during a time when said conduit is lowered into said borehole;

blocking liquid from passing upwardly through the conduit with a non-return valve located in the conduit;

placing a cementitious material into the borehole via the grout pipe until the cementitious material engages the formation and rises at least above the inlet of the conduit and envelopes the bottom end of said conduit, and placing the cementitious material around the bottom of the grout pipe, and letting the cementitious material set to fix the conduit and the grout pipe to the borehole;

pumping a liquid down the conduit through the non-return valve, out of the inlet of the conduit and into the cementitious material in the borehole so that the liquid displaces the cementitious material around the inlet of the conduit and forms a fluid connection to the formation before the cementitious material around the inlet of the conduit is fully set; and placing a pressure sensing device in said conduit at a location below the surface of the borehole to measure the fluid pressure of the formation at said depth via the displaced cementitious material.

2. The method according to claim 1, further including pumping the liquid down the conduit to form the fluid connection to the formation before the cementitious material around the inlet of the conduit is fully set, allowing an adequate time for the cementitious material to set, and then injecting a pressurised liquid of sufficient pressure between the inlet of the conduit and the formation, thereby forming a hydrofracture that extends laterally through the cementitious material and into the formation.

3. The method according to claim 1, further including using a non-return valve that is pre-loaded with a pressure relief valve, and placing the non-return valve within the conduit with the pressure sensing device located below the non-return valve, whereby the pressure sensing device is in fluid connection with the formation fluid and yet isolated from the pressure above the non-return valve by an operating pressure of the pressure relief valve.

4. The method according to claim 1, whereby when the cementitious material is set, removing the non-return valve and introducing the pressure sensing device into the conduit and sealing it in place to monitor pressure.

5. The method according to claim 4, further including sealing the pressure sensing device into the conduit with a packer located within the conduit.

6. The method according to claim 5, further including attaching the pressure sensing device to a bottom of the packer, and holding the packer and pressure sensing device within a conduit located near a surface of the borehole, wherein the conduit is larger than the packer and pressure sensing device that it holds.

7. The method according to claim 1, further including enveloping the pressure sensor with the cementitious material to fix the pressure sensor within the borehole.

8. The method according to claim 7, further including connecting the non-return valve, the pressure sensing device and the filter to a connector block to provide a pressure sensor arrangement, so that filtered formation fluid is supplied to the non-return valve and the pressure sensing device.

9. The method according to claim 8, further including locating the pressure sensor arrangement in the borehole at the formation location where the formation pressure is to be measured.

10. The method according to claim 7, further including connecting the pressure sensing device in the conduit at a location below the surface of the borehole so that the pressure sensing device can be removed without removing the conduit.

11. The method according to claim 10, further including connecting the pressure sensing device to a bottom of a packer, and setting the packer in the conduit location below the surface of the borehole.

12. The method according to claim 11, further including removing the non-return valve and using the packer to prevent passage of formation fluid upwardly all the way through the conduit.

13. The method according to claim 1, further including placing a filter at the inlet of the conduit, and pumping a liquid down the conduit through the non-return valve to clear the filter of the cementitious material before setting thereof and to form a void pocket around the filter.

14. The method of claim 1, further including pumping the cementitious material down the borehole using a grout pipe, and enclosing all sides of a bottom portion of said grout pipe including a bottom end of said grout pipe with the cementitious material that becomes set, and enclosing all sides of at least a bottom portion of said conduit and a bottom end of said conduit with the cementitious material so as to entirely envelope the bottom portion of said conduit, whereby the hardened cementitious material provides lateral support to said grout pipe and to said conduit in said borehole.

15. A method of monitoring a fluid pressure in a subterranean formation, comprising:

forming a borehole in the subterranean formation at least to a depth where the fluid pressure is to be measured;

lowering a conduit pipe into the borehole until an inlet of the conduit pipe is at a depth adjacent an uncased portion of the borehole where the formation pressure is to be measured;

lowering a grout pipe down into the borehole, where said grout pipe is separate from said conduit pipe and movable with respect to said conduit pipe;

forcing a cementitious material down the grout pipe to fill the borehole with the cementitious material to a level substantially above the inlet of the conduit pipe and preventing the cementitious material from flowing up the conduit pipe with a non-return valve, whereby the cementitious material surrounds the inlet of the conduit pipe so that the bottom of said conduit pipe is fully enveloped by the cementitious material and is fixed in the uncased portion of the borehole when the cementitious material sets;

purging the inlet of the conduit pipe of cementitious material by pumping a liquid down the conduit pipe and through the non-return valve and out of the inlet of the conduit pipe;

the pumping of the liquid down the conduit pipe forms a fluid connection to the formation before the cementitious material around the inlet of the conduit pipe is fully set, forming the fluid connection by forming a lateral fluid path between the inlet of the conduit pipe through the cementitious material and to the formation by displacing the cementitious material around the inlet of the conduit pipe when the pumped liquid exits the conduit pipe inlet, whereby the formation pressure forces the formation fluid to flow through the fluid path and through the inlet of the conduit pipe; and removing the non-return valve from the conduit pipe before connecting a pressure sensing device under a packer and placing the packer and attached pressure sensor in the conduit pipe to block the conduit pipe and allow the pressure sensor to sense fluid pressures of the formation via the inlet of the conduit pipe.

* * * * *